US008887475B2

(12) United States Patent
Ghelfi

(10) Patent No.: US 8,887,475 B2
(45) Date of Patent: Nov. 18, 2014

(54) LEVELING AND ALIGNING DEVICE FOR INSTALLING TILES

(71) Applicant: GHELFI S.r.l., Bologna (IT)

(72) Inventor: Stefano Ghelfi, Bologna (IT)

(73) Assignee: GHELFI S.r.l. (IT)

( * ) Notice: Subject to any disclaimer, the term of this patent is extended or adjusted under 35 U.S.C. 154(b) by 0 days.

(21) Appl. No.: 14/063,429

(22) Filed: Oct. 25, 2013

(65) Prior Publication Data

US 2014/0116001 A1 May 1, 2014

(30) Foreign Application Priority Data

Oct. 30, 2012 (IT) ..... BO2012A0593

(51) Int. Cl.
*E04D 15/00* (2006.01)
*E04F 21/22* (2006.01)
*E04F 21/00* (2006.01)

(52) U.S. Cl.
CPC ..... *E04F 21/22* (2013.01); *E04F 21/0092* (2013.01)
USPC ..... 52/749.11

(58) Field of Classification Search
CPC ..... E04F 21/22; E04F 21/20
USPC ..... 52/749.11, 384–392, 126.1, 127.1
See application file for complete search history.

(56) References Cited

U.S. PATENT DOCUMENTS 5,603,195 A * 2/1997 Cosentino ..... 52/749.11
7,992,354 B2 8/2011 Doda, Jr.
8,429,878 B1 * 4/2013 Hoffman et al. ..... 52/747.11
8,671,628 B2 * 3/2014 Sighinolfi ..... 52/126.1
8,689,522 B2 * 4/2014 Hoffman et al. ..... 52/747.11
2010/0186344 A1 7/2010 Jones
2010/0287868 A1 * 11/2010 Kufner et al. ..... 52/391
2014/0033640 A1 * 2/2014 Gorton ..... 52/747.11

FOREIGN PATENT DOCUMENTS

WO 2011/121476 10/2011

OTHER PUBLICATIONS

Italian Search Report dated Jun. 26, 2013 from counterpart Italian App No. BO2012A000593.

European Search Report dated Mar. 6, 2014 from counterpart App No. 13189827.2.

* cited by examiner

*Primary Examiner* — Mark Wendell

(74) *Attorney, Agent, or Firm* — Timothy J. Klima; Shuttleworth & Ingersoll, PLC

(57) ABSTRACT

This invention relates to a leveling and aligning device for installing tiles and which comprises a wedge for leveling the tiles and a main body; more specifically, the main body has a supporting base and at least one vertical member extending along an axis substantially perpendicular to the base and connected to the supporting base along a preferential fracturing line; the first vertical member has an opening extending from the supporting base, designed to receive the leveling wedge, and a contact portion designed to engage with the leveling wedge; the first vertical member comprises at least one pair of first side tabs having a thickness greater than the thickness of the first vertical member.

21 Claims, 5 Drawing Sheets

LEVELING AND ALIGNING DEVICE FOR INSTALLING TILES

This application claims priority to Italian Patent Application BO2012A000593 filed Oct. 30, 2012, the entirety of which is incorporated by reference herein.

BACKGROUND OF THE INVENTION

This invention relates to a leveling and aligning device for installing tiles.

Generally speaking, leveling and aligning devices for installing tiles are used in the building construction sector and allow tiles, paving blocks and the like to be installed in such a way that they are correctly arranged relative to each other and properly spaced, thus greatly facilitating tile installation.

Document US799235462 discloses a tile leveling and aligning device which comprises a supporting base and a spacing member connected to the supporting base at right angles to the supporting base. More specifically, the spacing member is connected to the supporting base along a preferential fracturing line.

The spacing member divides the supporting base into two separate portions, each of which has a respective tile placed on it.

More specifically, the tiles are placed on top of the supporting base with their respective edges in abutment along the spacing member in such a way that they are laid at a reciprocal distance which is equal to the thickness of the spacing member.

It should be noted that precise laying requires at least two leveling devices for each side of each tile.

Once the tiles have been laid using the leveling devices, they can be leveled in height using a wedge which can be inserted by sliding into a through slot formed in the spacing member.

Once the tiles have been laid, the spacing member of each device is removed from the respective supporting base along the preferential fracturing line by knocking the wedge out of the spacing member, while the supporting base remains embedded under the tiles.

Although the leveling device described is easy to make and use, it has several disadvantages.

A first disadvantage is that the device is not versatile because it cannot be used to place the tiles at a reciprocal distance greater than the thickness of the spacing member.

Moreover, the device described cannot be used to align three or four tiles relative to each other to make a T- or X-shaped joint.

Document WO2011121476A1 discloses another leveling device which at east partly overcomes the above mentioned disadvantages.

Like the other device already described, this device comprises a supporting base and an abutment member connected thereto along a preferential fracturing line.

The abutment member has a passage extending from the supporting base and into which a tile leveling wedge can be inserted.

The device also comprises a spacer body having a slit in which the abutment member can be inserted in such a way that the spacer body itself defines a passage for the leveling wedge, so as to be interposed between the supporting base and the leveling wedge.

In order to make what is known as the "grout joints" or spaces between the tiles, the spacer body comprises two spacer elements aligned with the slit in the spacer body.

The spacer body also comprises a further spacer portion which is elongate in shape and positioned alongside the slit and at right angles thereto.

In this device, the spacer body is adapted to make the joints or spaces for the grout between one tile and another and, in particular, the two spacer elements and the elongate spacer portion make the cross-shaped joints where four tiles meet.

Furthermore, since the elongate spacer portion is positioned on a single face of the spacer body, spaces between two adjacent tiles can be made by turning the spacer body upside down.

The spacer body partly solves the drawbacks of the device described previously but at the expense of ease of use, since the spacer body is itself an added part to be used together with the abutment member to make not only joints between two adjacent tiles but also cross-shaped joints where the corners of four tiles meet.

The spacer body also involves a further loss of time when the device has to be assembled because the user must be very careful to turn the spacer body the right way round with the correct face towards the tiles, depending on the type of grout joint to be made.

AIM OF THE INVENTION

The aim of this invention is to provide a leveling and aligning device for installing tiles, which can overcome the above mentioned disadvantages of the prior art and which is at once easy to use and make and economically advantageous.

BRIEF DESCRIPTION OF THE DRAWINGS

The technical features of the invention, with reference to the above aims, are clearly described in the appended claims and its advantages are apparent from the detailed description which follows, with reference to the accompanying drawings which illustrate a preferred non-limiting example embodiment of it, and in which:

DESCRIPTION OF THE PREFERRED EMBODIMENTS

Figure 1:
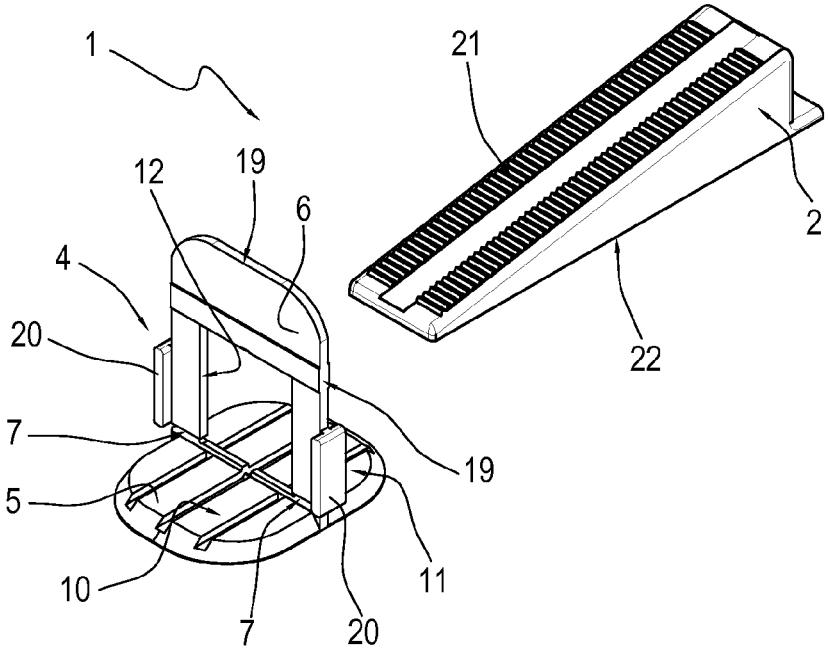
FIG. 1 is a schematic perspective view ref a leveling and aligning device according to this invention.

The reference numeral 1 denotes a leveling and aligning device for installing tiles and which comprises a wedge 2 for leveling the tiles 3 and a main body 4.

The main body 4 comprises a supporting base 5 and at least one vertical member 6 connected to the supporting base 5 along a preferential fracturing line 7.

The base 5 extends mainly along a horizontal direction, giving the device 1 greater stability and guaranteeing flatness to the tiles 3 to be installed.

The base 5 comprises a supporting underside face 8, designed to come into contact with the installation surface of the tiles 3, and a supporting top face 9, opposite the supporting underside face 8, on which the tiles 3 are placed.

The supporting underside face 8 and the supporting top face 9 are both substantially planar and lie in respective parallel planes.

In the first embodiment illustrated in FIGS. 1 to 6, which will be described below, the leveling and aligning device 1 comprises a first vertical member 6.

The first vertical member 6 extends along an axis V, substantially perpendicular to the base 5.

More specifically, the first member 6 is positioned at right angles to the base 5, subdividing it into a first and a second portion 10 and 11 on which respective tiles 3 are placed.

Preferably, the first vertical member 6 is located at a substantially central position of the base 5, so that the first and the second portion 10 and 11 are the same size. Thus, the main body 4 is symmetrical about the vertical axis V.

The vertical member 6 has an opening 12 extending from the supporting base 5 and defined by an upper edge 14 and two lateral edges 15*a*.

The first member 6 comprises a contact portion 13 located along the upper edge 14 of the opening 12.

The opening 12 is adapted to receive the leveling wedge 2 which is insertable therein.

The opening 12 gives the first vertical member 6 a portal structure comprising two vertical arms 15 which delimit the lateral openings 15*a* of the opening 12, and a top portion 16 connecting the vertical arms 15 to each other, which delimits the upper edge 14 of the opening 12.

The contact portion 13 is connected to the top portion 16 and is located between the two vertical arms 15.

The first vertical member 6 comprises a first and a second front face 17 and 18 connected to the same perimeter edge 19.

Figure 3:
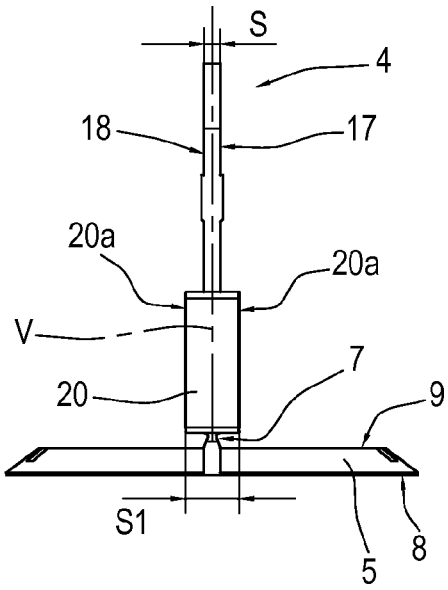
FIG. 3 is a side view of the main body of the leveling and aligning device of FIG. 1.

The perimeter edge 19 defines the thickness s of the first vertical member 6, as illustrated in FIG. 3.

The first vertical member 6 comprises at one pair of first side tabs 20, extending parallel to the vertical axis V.

The first side tabs 20 have a thickness s1 greater than the thickness s of the first vertical member 6, as illustrated in FIG. 3.

It should be noted that the expression "thickness of the first vertical member 6" is used to mean the distance between the first and second front faces 17 and 18, which are on opposite sides of and externally delimit the selfsame first vertical member 6.

The expression "thickness of the first side tabs 20" means the distance between the lateral edges 20*a* which are on opposite sides of and delimit the selfsame first side tabs 20.

In the preferred embodiment, the first side tabs 20 project from the perimeter edge 19 of the first vertical member 6.

The first vertical member 6 is a substantially plane element of thickness s and the first tabs 20 project laterally relative to the first member 6 and define the maximum lateral dimensions of the selfsame first member 6.

Figure 4:
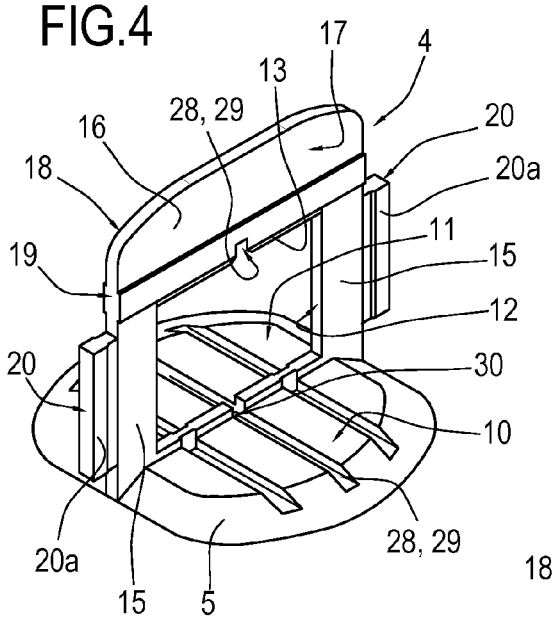
FIG. 4 is a perspective view of a second embodiment of the main body of the leveling and aligning device of FIG. 1.
Figure 5:
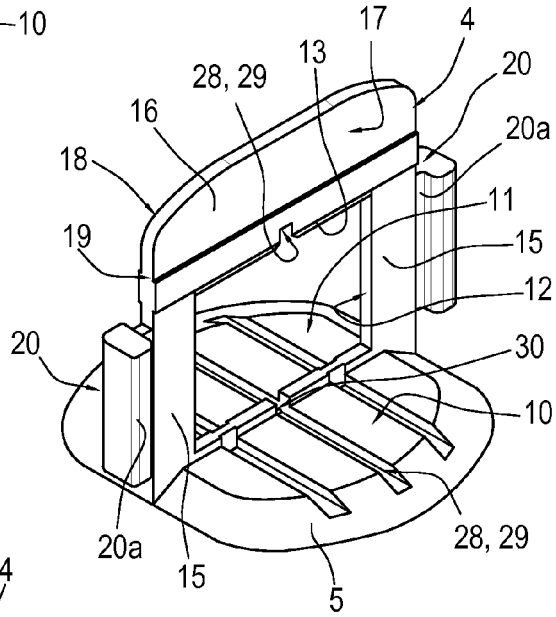
FIG. 5 is a perspective view of a third embodiment of the main body of the leveling and aligning device of FIG. 1.
Figure 6:
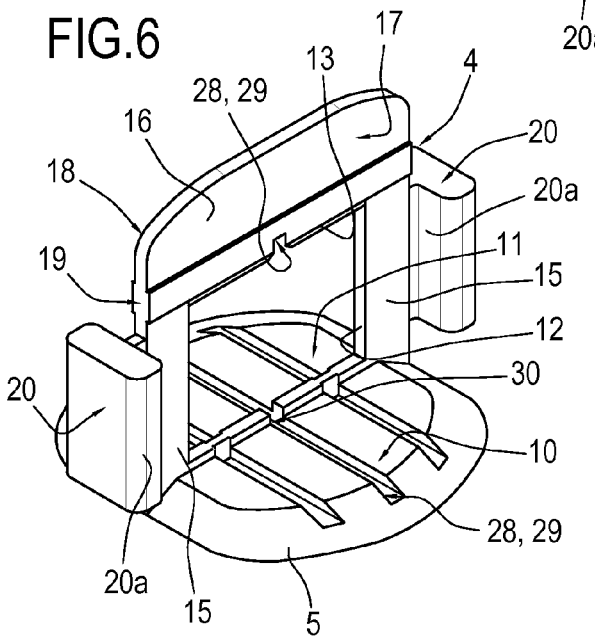
FIG. 6 is a perspective view of a fourth embodiment of the main body of the leveling and aligning device of FIG. 1.

The thickness of the first side tabs 20 is variable as a function of the main cross section of the tabs themselves, with reference to a plane at right angles to the vertical axis V and parallel to the supporting base 5, as illustrated in FIGS. 4 to 6.

Preferably, the first tabs 20 are located at the ends of the first vertical member 6.

Alternatively, the first side tabs 20 may project from the first and the second front face 17 and 18 of the first vertical member 6. More specifically, the first side tabs 20 may project from the vertical arms 15.

Advantageously, the first side tabs 20 extend away from the base 5 starting from the preferential fracturing line 7.

The first side tabs 20 extend from the preferential fracturing line 7 towards the top portion 16 of the first member 6 along a direction parallel to the vertical axis V.

In other words, the side tabs 20 extend from the perimeter edges 19 of the first vertical member 6 only in a zone above the preferential fracturing line.

Thus, the first side tabs 20 do not extend beyond the preferential fracturing line 7 towards the supporting base 5.

Advantageously, that means that the first side tabs 20 also come fully away when the first member 6 is removed, so as to prevent them from being embedded in the grout joints of the tiles 3.

FIGS. 4 to 6 illustrate different embodiments of the main body 4 which differ in the shape of the first side tabs 20, and in particular, in their thickness.

More specifically, the thickness of the first side tabs 20 increases in order of illustration in FIGS. 4 to 6.

Advantageously, the user chooses to use the main body 4 having the first tabs 20 with the desired thickness.

In use, the leveling and aligning device 1 according to the first embodiment is positioned between two tiles 3 placed side by side along their edges 3*a*, until they come into abutment with the first side tabs 20.

More specifically, each tile 3 is positioned on top of the respective first and second portion 10 and 11 of the base 5 in such a way that the first member 6 is interposed between the two tiles 3.

The first side tabs 20, being connected to the first member 6, are interposed between the edges 3*a* of the respective tiles 3 and position the latter at a reciprocal distance equal to the thickness s1 of the first side tabs 20 themselves.

Advantageously, the first side tabs 20 position the edges 3*a* of the tiles 3 parallel to each other.

Once the tiles have been positioned relative to each leveling and aligning device 1, the leveling wedge 2 is inserted into the opening 12 of the respective main body 4 until the leveling wedge 2 comes into abutment against the contact portion 13.

The leveling wedge 2 has an inclined toothed surface 21 designed to engage the contact portion 13. In effect, the leveling wedge 2 is inserted into the opening 12 until one of the teeth 21 grips the contact portion 13.

The leveling wedge 2 has a plane surface 22 on the side opposite to the inclined face 21 and designed to come into contact with the tiles 3 to be leveled.

More precisely, to level the tiles 3 at the same height, the plane surface 22 presses the tiles 3 towards the base 5 of the main body 4, in particular towards the supporting top face 9 along a direction perpendicular to the plane surface 22 itself.

In order to align and correctly level the tiles 3, one or more leveling and aligning devices 1 are used for each edge 3*a* of each tile 3.

When laying of the tiles 3 and of the respective leveling and aligning devices 1 has been completed, the first vertical members 6 can be removed from the respective bases 5 along the preferential fracturing lines 7.

More specifically, the first vertical members 6, and the first side tabs 20 with them, are removed by knocking out the leveling wedge 2 of the respective device 1.

Advantageously, removing the first side tabs 20 together with each first vertical member 6 makes it possible to make smooth, even grout joints because the first side tabs 20 do not remain embedded between the tiles 3.

In further embodiments, illustrated in FIGS. 7 to 13, the leveling and aligning device 1 comprises a second vertical member 23 at right angles to the first member 6.

The second vertical member 23 comprises at least one second side tab 24 extending parallel to the vertical axis V.

The second vertical member 23 advantageously comprises a pair of second side tabs 24.

The second vertical member 23 is a substantially plane member with thickness s" and the second tabs 20 extend laterally relative to the second member 23, forming the maximum lateral dimensions of the second member 23.

The second vertical member 23 comprises a first and a second front face 25 and 26 connected to the same perimeter edge 27 defining the thickness s" of the second member 23.

Figure 7:
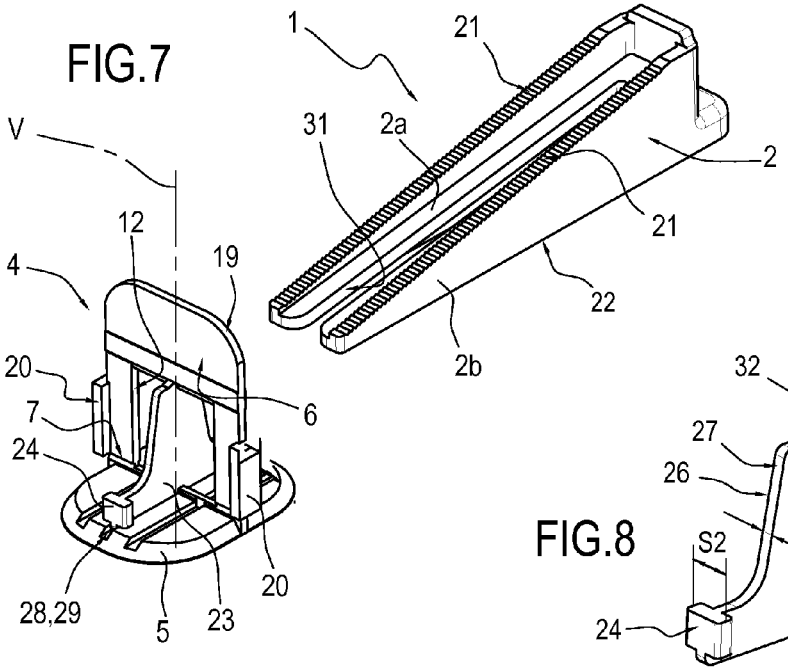
FIG. 7 is a perspective view of a second embodiment of the leveling and aligning device according to the invention.
Figure 8:
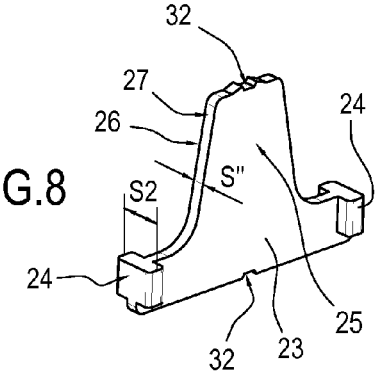
FIG. 8 shows a scaled-up detail from FIG. 7.
Figure 9:
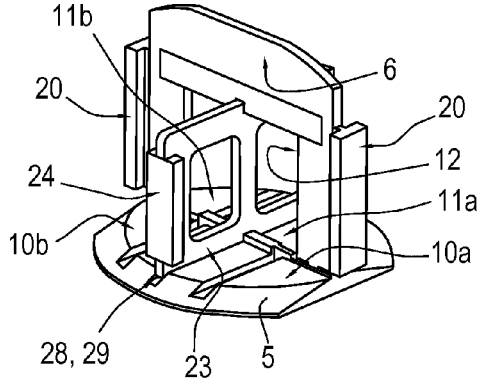
FIG. 9 is a perspective view of a further embodiment of the leveling and aligning device illustrated in FIG. 7.

The second side tabs 24 have a thickness s2 greater than the thickness s" of the second vertical member 23, as illustrated in FIG. 7.

In order to make all the grout joints of the same size, the second side tabs 24 have a thickness s2 equal to the thickness s1 of the first side tabs 20, since the second tabs 24 are interposable between two tiles and form a reciprocal distance equal to the thickness s2.

Preferably, the second side tabs 24 project from the perimeter edge 27 of the second vertical member 23.

Alternatively, the second side tabs 24 may project from the first and the second front face 25 and 26 of the second vertical member 23.

The second vertical member 23 comprises a pair of second side tabs 24 extending away from the base 5 starting from the preferential fracturing line 7.

In other words, the second side tabs 24 extend from the preferential fracturing line 7 towards the top portion of the second vertical member 23 along a direction parallel to the vertical axis V.

That way, when the second vertical member 23 is removed, the second side tabs 24 are also fully removed.

Advantageously, the second vertical member 23 is removable from the main body 4 of the device 1 and can be fitted when required, that is to say, to make grout joints at a point where three or more tiles 3 meet.

In order to fit the second vertical member 23 to the main body 4, the base 5 and the first vertical member 6 comprise respective guides 28 for insertion of the second member 23.

More specifically, one guide 28 is formed on the supporting top face 9 of the base 5 and another guide 28 is formed on the contact portion 13 of the first member 6, facing the guide 28 on the supporting base 5.

Each guide 28 comprises a groove 29 whose profile mates with the perimeter edge 27 of the second vertical member 23 and in which the selfsame second member 23 engages.

Figure 2:
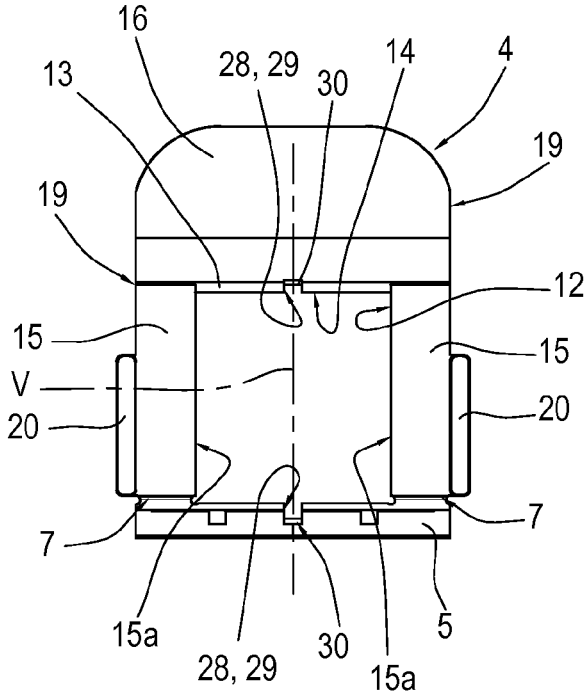
FIG. 2 is a front view of the main body of the leveling and aligning device of FIG. 1.

The guide 28 formed on the base 5 comprises a tooth 30, shown in FIG. 2, for locking the second vertical member 23 once inserted in the guide 28.

The second vertical member 23 has a first notch 32 designed to engage the locking tooth 30 of the guide 28 formed on the supporting base and a second notch 33 designed to engage the locking tooth 30 of the guide 28 formed on the first member 6.

The second vertical member 23 can be inserted, by way of the guide 28, into the opening 12 of the first member 6, thus dividing the supporting base 5 into four separate portions.

In other words, the first and the second portion 10 and 11 of the base 5, obtained by dividing the first member 6, are each in turn divided into two respective separate portions 10*a*, 10*b*, 11*a*, 11*b*.

Each of the four portions 10*a*, 10*b*, 11*a*, 11*b* of the base 5 is adapted to receive a corner portion of a tile 3 in order to correctly align the tiles 3 at the point where three or four tiles meet, thereby making corresponding grout joints.

More precisely, each of the side tabs 20 and 24, both of the first and of the second member 6 and 23, is designed to come into contact with two respective edges 3*a* belonging to two distinct tiles 3.

Figure 12:
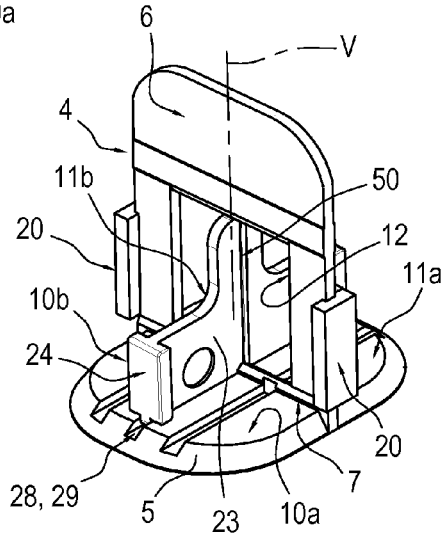
FIG. 12 is a perspective view of a further embodiment of the leveling and aligning device according to the invention.
Figure 13:
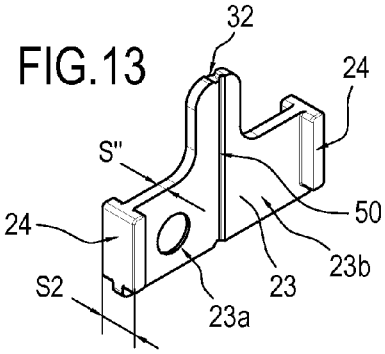
FIG. 13 is a perspective view of a detail from FIG. 12.

The second member 23, in the embodiment of it illustrated in FIGS. 12 and 13, has a preferential fracturing line 50 running parallel to the vertical axis V and coinciding with an axis of symmetry of the selfsame member 23.

When the circumstances so require, the preferential fracturing line 50 allows the second member 23 to be divided into two halves 23*a*, 23*b*, one of which can be easily removed from the main body 4.

Figure 14:
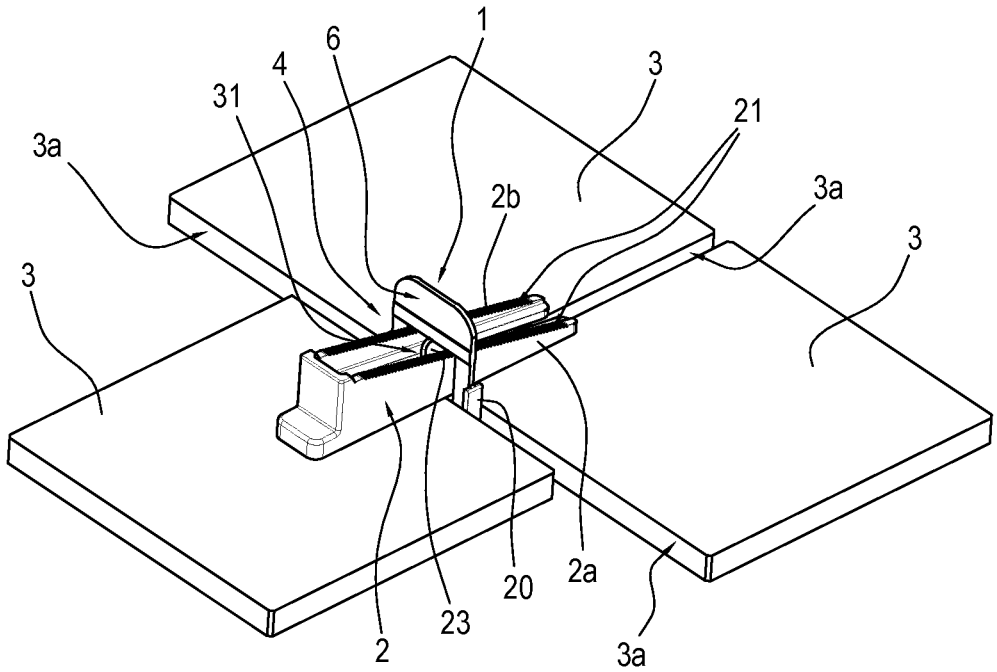
FIG. 14 is a perspective view from above showing the leveling and aligning device of FIG. 12.

This operation is useful for laying tiles in what are known as "stretcher" or "herringbone" patterns, that is, where the device 1 is in contact with three tiles, as illustrated in FIG. 14.

Generally speaking, in order to level the tiles 3 placed on the base 5, the leveling wedge 2 has a cavity 31 which divides it into two separate portions 2*a*, 2*b*.

The two separate portions 2*a*, 2*b* are insertable into the opening 12 of the first vertical member 6.

More specifically, since the opening 12 is divided into two distinct windows by the second vertical member 23, each portion 2*a*, 2*b* of the wedge 2 is inserted into a respective window. When the wedge 2 is inserted into the opening 12, the cavity 31 receives a portion of the second vertical member 23.

Figure 10:
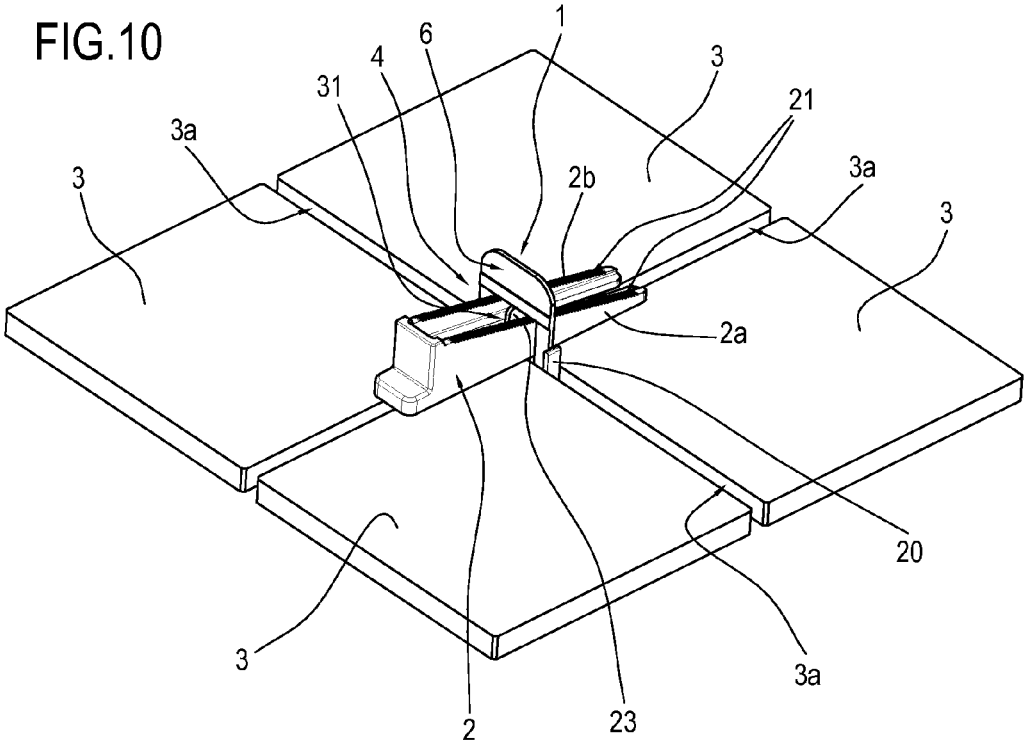
FIG. 10 is a perspective view from above showing the leveling and aligning device of FIG. 7 in its configuration for use.
Figure 11:
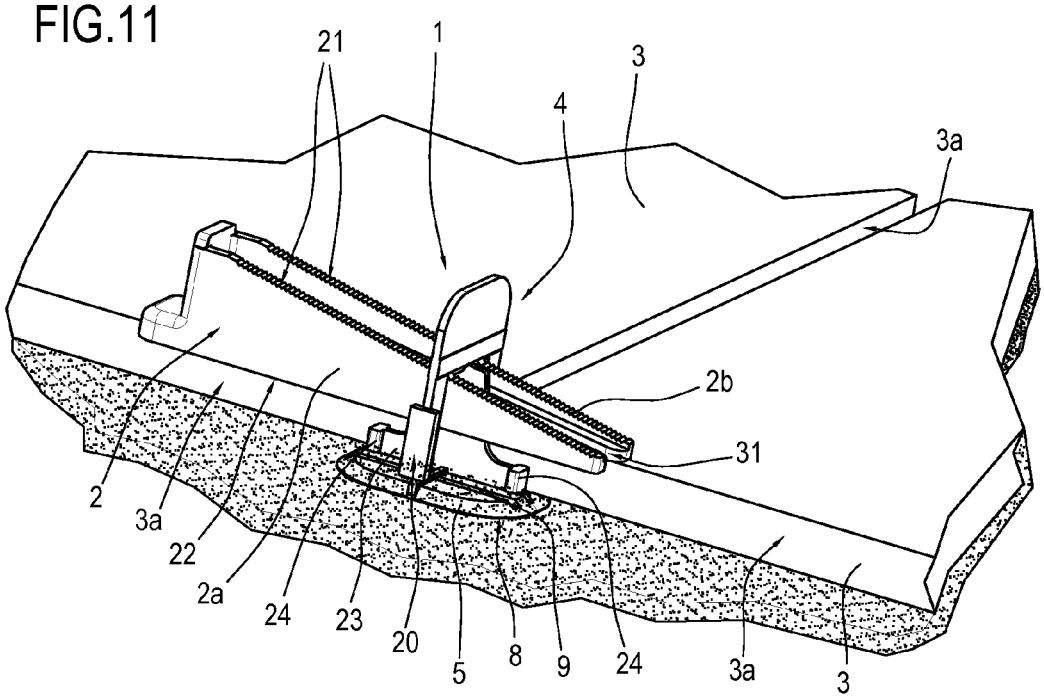
FIG. 11 is a perspective view, with some parts cut away in order to better illustrate others, of the leveling and aligning device of FIG. 10.

The leveling wedge 2 made in this way allows simultaneously leveling up to four tiles 3 at a respective corner portion, as illustrated in FIGS. 10 and 11.

It should be noted that the leveling wedge 2 divided into two portions 2*a*, 2*b* may be also be used with the first embodiment of the main body 4.

The tiles 3 can then be leveled in the same way as described above.

It should be noted that the second embodiment allows leveling and aligning four tiles to make what are known as "cross-shaped" grout joints. To make T-shaped grout joints, where three tiles meet, it is sufficient to fit to the main body 4 the second vertical member 23 without one of the second tabs 24 and one of the portions of the second member 23, in such a way that it falls within the range of dimensions of the first tabs 20.

In an alternative embodiment not illustrated, the second member 23 and the first member 6 are rigidly connected to each other. In this case, the second member 23 is connected to the base 5 by its own preferential fracturing line 7.

Thus, once the tiles 3 have been laid, the first and the second member 6 and 23 are removed simultaneously and with them the respective first and second side tabs 20 and 24.

The leveling and aligning device 1 for installing tiles 3 overcomes the disadvantages of the prior art and brings important advantages.

Advantageously, the leveling and aligning device 1 is easy to make and to use since all the user has to do is fit the main body 4 only with the first vertical member 6 to make grout joints between two tiles 3 placed simply side by side, or fit the main body 4 also with the second vertical member 23 to make grout joints where three or four tiles meet. Another advantage is the possibility of making grout joints of different thicknesses using a main body 4 having side tabs 20 and 24 with the desired thickness.

What is claimed is:

1. A leveling and aligning device for installing tiles comprising:

a main body comprising a supporting base and a first vertical member connected to the supporting base along a preferential fracturing line and extending along an axis substantially perpendicular to the base, the first vertical member having a substantially plane main shape having a predetermined thickness;

a wedge for leveling the tiles;

the first vertical member having an opening extending from the supporting base, constructed and arranged to receive the leveling wedge, and a contact portion constructed and arranged to engage with a surface of the leveling wedge facing away from the supporting base when the wedge is positioned in the opening;

wherein, the first vertical member comprises a pair of first side tabs, extending parallel to the axis, having a thickness greater than the thickness of the first vertical member; at least one of the pair of first side tabs being interposable between two tiles facing each other, for forming a spacing distance between the two tiles.

2. The device according to claim 1, wherein the first side tabs extend, away from the base along a direction parallel to the axis, starting from the preferential fracturing line.

3. The device according to claim 2, wherein the first tabs extend laterally relative to the first vertical member, forming a maximum lateral dimension of the first vertical member.

4. The device according to claim 1, comprising a second vertical member, positioned at a right angle to the first vertical member, comprising a second side tab extending parallel to the vertical axis and having a thickness equal to the thickness of the first side tabs; the second side tab being interposable between a third tile facing one of the two tiles, for forming a spacing distance between the third tile and the one of the two tiles.

5. The device according to claim 4, wherein the second vertical member comprises a pair of second side tabs which extend, away from the base, along the direction parallel to the axis, starting from the preferential fracturing line.

6. The device according to claim 5, wherein the second vertical member is a substantially plane member having a thickness and the second side tabs extend laterally relative to the second vertical member, forming a maximum lateral dimension of the second vertical member.

7. The device according to claim 6, wherein the second vertical member is removably insertable into the opening, the supporting base and the first vertical member comprise respective guides for inserting the second vertical member into the opening.

8. The device according to claim 7, wherein each guide comprises a groove having a profile constructed and arranged to receive a perimeter edge of the second vertical member.

9. The device according to claim 8, wherein each guide comprises a tooth for locking the second vertical member once inserted in the guide; the second vertical member comprises a first and a second notch constructed and arranged to engage a respective locking tooth.

10. The device according to claim 9, wherein the second vertical member has a preferential fracturing line running parallel to the vertical axis.

11. The device according to claim 10, wherein the preferential fracturing line defines an axis of symmetry of the second vertical member.

12. The device according to claim 11, wherein the leveling wedge has a cavity which divides the wedge into two separate portions which can be inserted inside the opening of the first vertical member; the cavity housing a portion of the second vertical member.

13. The device according to claim 12, wherein the first side tabs extend, away from the base along a direction parallel to the axis, starting from the preferential fracturing line.

14. The device according to claim 13, wherein the first tabs extend laterally relative to the first vertical member, forming a maximum lateral dimension of the first vertical member.

15. The device according to claim 4, wherein the second vertical member is removably insertable into the opening, the supporting base and the first vertical member comprise respective guides for inserting the second vertical member into the opening.

16. The device according to claim 15, wherein each guide comprises a groove having a profile constructed and arranged to receive a perimeter edge of the second vertical member.

17. The device according to claim 16, wherein each guide comprises a tooth for locking the second vertical member once inserted in the guide; the second vertical member comprises a first and a second notch constructed and arranged to engage a respective locking tooth.

18. The device according to claim 4, wherein the second vertical member has a preferential fracturing line running parallel to the vertical axis.

19. The device according to claim 4, wherein the preferential fracturing line defines an axis of symmetry of the second vertical member.

20. The device according to claim 4, wherein the leveling wedge has a cavity which divides the wedge into two separate portions which can be inserted inside the opening of the first vertical member; the cavity housing a portion of the second vertical member.

21. A leveling and aligning device for installing tiles comprising:

a main body comprising a supporting base and a first vertical member connected to the supporting base along a preferential fracturing line and extending along an axis substantially perpendicular to the base, the first vertical member having a substantially plane main shape having a predetermined thickness;

a wedge for leveling the tiles;

the first vertical member having an opening extending from the supporting base, constructed and arranged to receive the leveling wedge, and a contact portion constructed and arranged to engage with the leveling wedge;

wherein, the first vertical member comprises a pair of first side tabs, extending parallel to the axis, having a thickness greater than the thickness of the first vertical member; at least one of the pair of first side tabs being interposable between two tiles facing each other, for forming a spacing distance between the two tiles;

a second vertical member, positioned at a right angle to the first vertical member, comprising a second side tab extending parallel to the vertical axis and having a thickness equal to the thickness of the first side tabs; the second side tab being interposable between a third tile facing one of the two tiles, for forming a spacing distance between the third tile and the one of the two tiles.

* * * * *